US007429831B2

(12) United States Patent
Gong

(10) Patent No.: US 7,429,831 B2
(45) Date of Patent: Sep. 30, 2008

(54) BALANCE CONTROLLING CIRCUIT

(75) Inventor: Xiao-Qiang Gong, Shenzhen (CN)

(73) Assignees: Innocom Technology (Shenzhen) Co., Ltd., Shenzhen, Guangdong Province (CN); Innolux Display Corp., Miao-Li County (TW)

( * ) Notice: Subject to any disclaimer, the term of this patent is extended or adjusted under 35 U.S.C. 154(b) by 16 days.

(21) Appl. No.: 11/584,885

(22) Filed: Oct. 23, 2006

(65) Prior Publication Data

US 2007/0090772 A1 Apr. 26, 2007

(51) Int. Cl.
*H05B 41/16* (2006.01)

(52) U.S. Cl. ..... 315/276; 315/282; 315/312

(58) Field of Classification Search ..... 315/276–277, 315/279, 282, 291, 312
See application file for complete search history.

(56) References Cited

U.S. PATENT DOCUMENTS 6,717,371 B2 * 4/2004 Klier et al. ..... 315/274
6,798,151 B1 9/2004 Chou et al.
7,061,183 B1 * 6/2006 Ball ..... 315/57
7,075,248 B2 * 7/2006 Hsieh et al. ..... 315/277
7,271,549 B2 * 9/2007 Wey et al. ..... 315/282
2005/0146286 A1 * 7/2005 Chan et al. ..... 315/276
2006/0273745 A1 * 12/2006 Wey et al. ..... 315/312
2007/0007910 A1 * 1/2007 Kim et al. ..... 315/282
2007/0052370 A1 * 3/2007 Huang ..... 315/277

* cited by examiner

*Primary Examiner*—Thuy Vinh Tran
*Assistant Examiner*—Tung X Le
(74) *Attorney, Agent, or Firm*—Wei Te Chung

(57) ABSTRACT

An exemplary balance controlling circuit (100) includes a transformer (T11), a first capacitor (C11), a second capacitor (C22), a first inductor (TC11), and a second inductor (TC12). The transformer includes two inputs (41, 42) connected to an external circuit, a grounded first output (43) and a second output (44). The second capacitor (C12) includes a first port (121) configured to connect to ground, and a second port (122) connected to the second output of the transformer. The first capacitor (C11) includes a second port (112) connected to the second output of the transformer, and a first port (111) connected to the first inductor and the second inductor. The first inductor includes a first output port ($I_1$). The second inductor includes a second output port ($I_2$), and a third output port ($I_3$).

13 Claims, 2 Drawing Sheets

BALANCE CONTROLLING CIRCUIT

FIELD OF THE INVENTION

The present invention relates to balance controlling circuits, and more particularly to a balance controlling circuit for cold cathode fluorescent lamps.

BACKGROUND

Liquid crystal displays (LCDs) are so-called non-self-emitting displays, which in general need a backlight module for the supply of light in order to display images. A typical backlight module generally includes a cold cathode fluorescent lamp (CCFL), and a balance controlling circuit for controlling operation of the CCFL. The precision of the current provided by the balance controlling circuit needs to meet a threshold requirement whereby the CCFL provides uniform, high luminance light, and whereby the lifespan of the CCFL can also be prolonged.

Referring to FIG. 3, a conventional balance controlling circuit 10 includes a transformer T1, six resistors R1, R2, R3, R4, R5, and R6, four capacitors C1, C2, C3, and C4, and a first inductor TC1 and a second inductor TC2.

The transformer T1 includes a first input 11, a second input 12, a first output 13, and a second output 14. The first inductor TC1 includes a first port 21, a second port 22, a third port 23, and a fourth port 24. The second inductor TC2 includes a first port 31, a second port 32, a third port 33, and a fourth port 34.

The first and second inputs 11, 12 of the transformer T1 connect to an external circuit, for example, a power supply (not shown). The first output 13 of the transformer T1 is grounded, and the second output 14 of the transformer T1 connects to one port of the capacitors C1 and C2 respectively. Another port of the capacitor C1 is connected in parallel to the capacitors C3, C4, which are both grounded. Said one port of the capacitor C2 also connects to the second port 22 of the first inductor TC1, and another port of the capacitor C2 connects to the fourth port 24 of the first inductor TC1 and the second port 32 of the second inductor TC2 respectively. The resistors R1, R2 are connected in series between the fourth and third ports 24, 23 of the first inductor TC1. The third port 23 of the first inductor TC1 connects to a first CCFL (not shown) via a first output port $I_{11}$.

The first port 21 of the first inductor TC1 connects to the fourth port 34 of the second inductor TC2. The resistors R3, R4 are connected in series between the second port 22 of the first inductor TC1 and the third port 33 of the second inductor TC2. The third port 33 of the second inductor TC2 also connects to a second CCFL (not shown) via a second output port $I_{12}$.

The resistors R5, R6 are connected in series between the first and second ports 31, 32 of the second inductor TC2. The first port 31 of the second inductor TC2 also connects to a third CCFL (not shown) via a third output port $I_{13}$.

The precision of the current for the CCFLs provided by the balance controlling circuit 10 can generally only be regulated to ±0.6 mA. This level of precision may not be considered satisfactory for certain backlight modules having high current precision requirements.

Accordingly, what is needed is a balance controlling circuit configured to be able to provide high precision operational capability.

SUMMARY

An exemplary balance controlling circuit includes a transformer, a first capacitor, a second capacitor, a first inductor, and a second inductor. The transformer includes a input, a first output and a second output, and the inputs thereof is configured to connect to an external circuit, and the first output thereof is configured to connect to ground. The first capacitor includes a first port and a second port, and the first port thereof connects to the second output of the transformer. The second capacitor includes a first port and a second port, the second port thereof is configured to connect to the ground, and the first port thereof connects to the second output of the transformer. The first inductor includes a first port, a second port, a third port, and a fourth port, and the first port and the third port thereof connect to the first port of the first capacitor. The second inductor includes a first port, a second port, a third port, and a fourth port, the third port thereof connects to the second port of the first inductor, and the first port of thereof connects to the first port and the third port of the first inductor and the first port of the first capacitor. The fourth port of the first inductor is the first output port, the fourth port of the second inductor is the second output port, and the second port of the second inductor is the third output port.

The first output port provides voltage for driving a first cold cathode fluorescent lamp, the second output port provides voltage for driving a second cold cathode fluorescent lamp, and the third output port provide voltage for driving a third cold cathode fluorescent lamp.

A detailed description of embodiments of the present invention is given below with reference to the accompanying drawings.

BRIEF DESCRIPTION OF THE DRAWINGS

In the drawings, all the views are schematic.

DETAILED DESCRIPTION OF PREFERRED EMBODIMENTS

Figure 1:
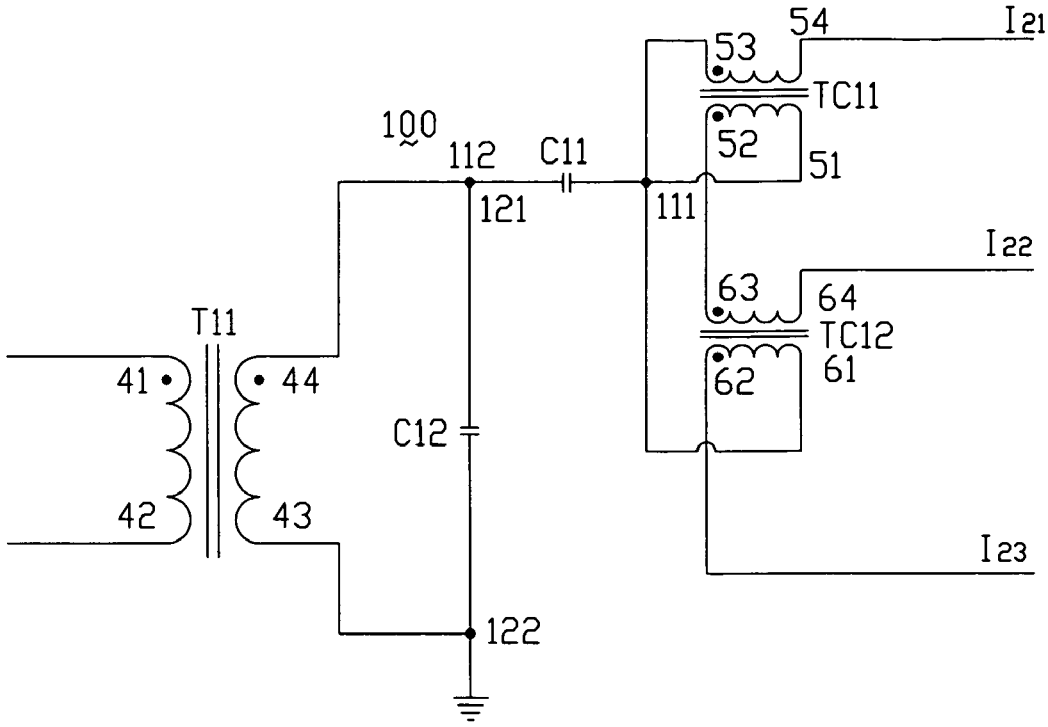
FIG. 1 is a diagram of a balance controlling circuit in accordance with a first embodiment of the present invention.

Referring to FIG. 1, a balance controlling circuit 100 in accordance with a first embodiment of the present invention includes a transformer T11, two capacitors C11 and C12, a first inductor TC11, and a second inductor TC12.

The transformer T11 includes a first input 41, a second input 42, a first output 43, and a second output 44. The first inductor TC11 includes a first port 51, a second port 52, a third port 53, and a fourth port 54. The second inductor TC12 includes a first port 61, a second port 62, a third port 63, and a fourth port 64. The capacitor C11 includes a first port 121, and a second port 122. The capacitor C12 includes a first port 111, and a second port 112.

The first and second inputs 41, 42 of the transformer T11 connect to an external circuit, for example, a power supply (not shown), and the first output 43 of the transformer T11 is grounded. The second and first ports 122, 121 of the capacitor C12 connect to the first and second outputs 43, 44 of the transformer T11 respectively, and the second port 122 of the capacitor C12 is also grounded. The second port 112 of the capacitor C11 connects to the first port 121 of the capacitor C12, and the first port 111 of the capacitor C11 connects to the first and third ports 51, 53 of the first inductor TC11 and the first port 61 of the second inductor TC12 respectively. The fourth port 54 of the first inductor TC11 connects to a first CCFL (not shown) via a first output port $I_{21}$.

The second port 52 of the first inductor TC11 connects to the third port 63 of the second inductor TC12. The fourth port 64 of the second inductor TC12 connects to a second CCFL (not shown) via a second output port $I_{22}$. The second port 62 of the second inductor TC12 connects to a third CCFL (not shown) via a third output port $I_{23}$.

The difference in impedance of each CCFL can be compensated by a coupling effect of impedance matching of the loadings of the CCFLs. The capacitor C11 can adjust the current output to the first, second, and third CCFLs flexibly, and the precision of the current is regulated to ±0.3 mA. The balance controlling circuit 100 can provide a high precision of current control for any kind of electrical device.

In various alternative embodiments, resistors can connect to the first and second ports 51, 52, 61, 62 of the first and second inductors TC11, TC12 respectively, and the third and fourth ports 53, 54, 63, 64 of the first and second inductors TC11, TC12 respectively, thereby protecting the balance controlling circuit 100 if any of the CCFLs fails. The capacitors C11, C12 can be replaced by several parallel or series connected capacitors, or by a high voltage capacitor.

Figure 2:
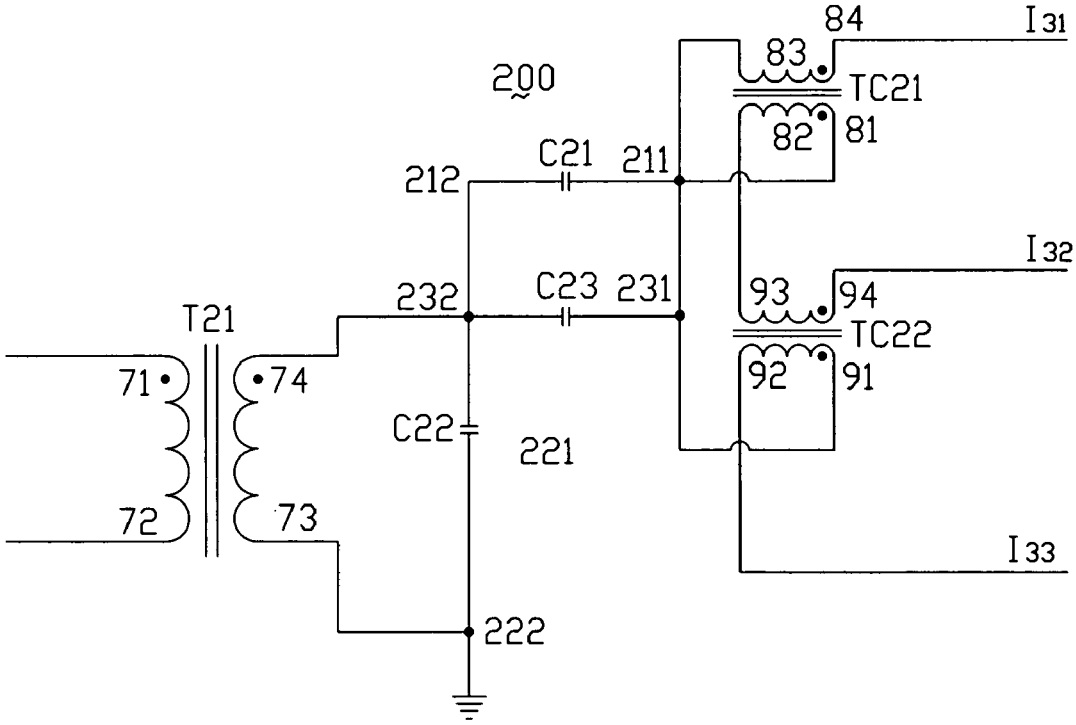
FIG. 2 is a diagram of a balance controlling circuit in accordance with a second embodiment of the present invention.
Figure 3:
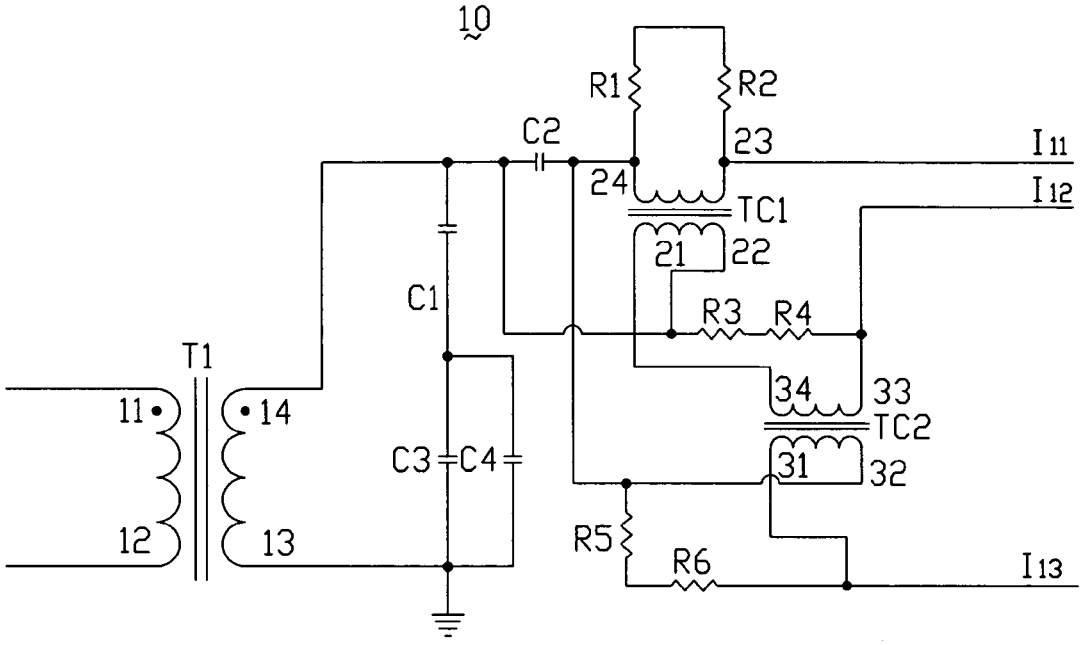
FIG. 3 (RELATED ART)
FIG. 3 is a diagram of a conventional balance controlling circuit.

Referring to FIG. 2, a balance controlling circuit 200 includes a transformer T21, three capacitors C21, C22, and C23, a first inductor TC21, and a second inductor TC22.

The transformer T21 includes a first input 71, a second input 72, a first output 73, and a second output 74. The first inductor TC21 includes a first port 81, a second port 82, a third port 83, and a fourth port 84. The second inductor TC22 includes a first port 91, a second port 92, a third port 93, and a fourth port 94. The capacitor C21 includes a first port 211 and a second port 212. The capacitor C22 includes a first port 221 and a second port 222. The capacitor C23 includes a first port 231 and a second port 232.

The first and second inputs 71, 72 of the transformer T21 connect to an external circuit, for example, a power supply (not shown), and the first and second outputs 73, 74 of the transformer T21 connect to the second and first ports 222, 221 of the capacitor C22 respectively. The second port 222 of the capacitor C22 is also grounded. The first port 221 of the capacitor C22 connects to the second port 212 of the capacitor C21 and the second port 232 of the capacitor C23 respectively. The first port 211 of the capacitor C21 connects to the first port 81 of the first inductor TC21. The first port 231 of the capacitor C23 connects to the third port 83 of the first inductor TC21 and the first port 91 of the second inductor TC22 respectively. The fourth port 84 of the first inductor TC21 connects to a first CCFL (not shown) via a first output port $I_{31}$.

The second port 82 of the first inductor TC21 connects to the third port 93 of the second inductor TC22. The fourth port 94 of the second inductor TC22 connects to a second CCFL (not shown) via a second output port $I_{32}$. The second port 92 of the second inductor TC22 connects to a third CCFL (not shown) via a third output port $I_{33}$.

The difference in impedance of each CCFL can be compensated by a coupling effect of impedance matching of the loadings of the CCFLs. The capacitor C23 can adjust the current output to the first, second, and third CCFLs flexibly. The proportion of current outputted via the output ports $I_{31}$, $I_{32}$, and $I_{33}$ can be controlled by verifying the proportion of the value of capacitors C21 and C23 to acquire a high precision of current adjustment. The precision of the current is regulated to ±0.3 mA. The balance controlling circuit 200 can provide a high precision of current control for any kind of electrical device.

In various alternative embodiments, resistors can connect to the first and second ports 81, 82, 91, 92 of the first and second inductors TC21, TC22 respectively, and the third and fourth ports 83, 84, 93, 94 of the first and second inductors TC21, TC22 respectively, thereby protecting the balance controlling circuit 200 if any of the CCFLs fails. The capacitors C21, C22, and C23 can be replaced by several parallel or series connected capacitors, or by a high voltage capacitor.

While various examples and embodiments have been described above, it is to be understood that the invention is not limited thereto. To the contrary, the above description is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A balance controlling circuit, comprising:

a transformer having an input, a first output, and a second output, wherein the input is configured to connect to an external circuit, and the first output is configured to connect to ground;

a first capacitor having a first port and a second port, wherein the first port connects to the second output of the transformer;

a second capacitor having a first port and a second port, wherein the second port is configured to connect to ground, and the first port connects to the second output of the transformer;

a first inductor having a first port, a second port, a third port, and a fourth port, wherein the first port and the third port of the first inductor connect to the first port of the first capacitor; and a second inductor having a first port, a second port, a third port, and a fourth port, wherein the third port of the second inductor connects to the second port of the first inductor, and the first port of the second inductor connects to the first port and the third port of the first inductor and the first port of the second capacitor respectively;

wherein the fourth port of the first inductor is configured to be a first output port, the fourth port of the second inductor is configured to be a second output port, and the second port of the second inductor is configured to be a third output port.

2. The balance controlling circuit as claimed in claim 1, wherein the first output port provides voltage for driving a first cold cathode fluorescent lamp, the second output port provides voltage for driving a second cold cathode fluorescent lamp, and the third output port provides voltage for driving a third cold cathode fluorescent lamp.

3. The balance controlling circuit as claimed in claim 1, wherein the first capacitor is a high voltage capacitor.

4. The balance controlling circuit as claimed in claim 1, wherein the second capacitor is a high voltage capacitor.

5. The balance controlling circuit as claimed in claim 1, wherein a resistor connects to the first port and the second port of the first inductor respectively, and a resistor connects to the third port and the fourth port of the first inductor respectively.

6. The balance controlling circuit as claimed in claim 1, wherein a resistor connects to the first port and the second port of the second inductor respectively, and a resistor connects to the third port and the fourth port of the second inductor respectively.

7. A balance controlling circuit, comprising:

a transformer having an input, a first output, and a second output, wherein the input is configured to connect to an external circuit, and the first output is configured to connect to ground;

a first capacitor having a first port and a second port, wherein the second port connects to the second output of the transformer;

a second capacitor having a first port and a second port, wherein the second port is configured to connect to ground, and the first port connects to the second output of the transformer;

a third capacitor having a first port and a second port, wherein the second port connects to the first port of the second capacitor;

a first inductor having a first port, a second port, a third port, and a fourth port, wherein the first port of the first inductor is connected to the first port of the first capacitor; and a second inductor having a first port, a second port, a third port, and a fourth port, wherein the first port of the second inductor connects to the third port of the first inductor and the first port of the third capacitor, and the third port of the second inductor connects to the second port of the first inductor;

wherein the fourth port of the first inductor is configured to be a first output port, the fourth port of the second inductor is configured to be a second output port, and the second port of the second inductor is configured to be a third output port.

8. The balance controlling circuit as claimed in claim 7, wherein the first output port provides voltage for driving a first cold cathode fluorescent lamp, the second output port provides voltage for driving a second cold cathode fluorescent lamp, and the third output port provides voltage for driving a third cold cathode fluorescent lamp.

9. The balance controlling circuit as claimed in claim 7, wherein the first capacitor is a high voltage capacitor.

10. The balance controlling circuit as claimed in claim 7, wherein the second capacitor is a high voltage capacitor.

11. The balance controlling circuit as claimed in claim 7, wherein the third capacitor is a high voltage capacitor.

12. The balance controlling circuit as claimed in claim 7, wherein a resistor connects to the first port and the second port of the first inductor respectively, and a resistor connects to the third port and the fourth port of the first inductor respectively.

13. The balance controlling circuit as claimed in claim 7, wherein a resistor connects to the first port and the second port of the second inductor respectively, and a resistor connects to the third port and the fourth port of the second inductor respectively.

* * * * *